United States Patent [19]

Isowa

[11] Patent Number: 4,530,693

[45] Date of Patent: Jul. 23, 1985

[54] DIE-CUTTING APPARATUS

[75] Inventor: Eiichi Isowa, Nagoya, Japan

[73] Assignee: Isowa Industry Co., Ltd., Nagoya, Japan

[21] Appl. No.: 445,220

[22] Filed: Nov. 29, 1982

[30] Foreign Application Priority Data

Nov. 30, 1981 [JP] Japan ..... 56-193377

[51] Int. Cl.[3] ..... B26D 7/06

[52] U.S. Cl. ..... 493/342; 83/117; 83/129; 83/139; 493/373

[58] Field of Search ..... 493/342, 373; 83/102, 83/103, 105, 107, 115–117, 129, 139

[56] References Cited

U.S. PATENT DOCUMENTS 3,528,330 9/1970 Ehlert ..... 493/342

FOREIGN PATENT DOCUMENTS 453353 9/1964 Japan ..... 493/242

*Primary Examiner*—David Simmons

*Attorney, Agent, or Firm*—Fleit, Jacobson, Cohn & Price

[57] ABSTRACT

A waste stripping unit is disposed downstream from a die cutter for cutting a sheet of paperboard into a product and waste and includes an upper roller having a male die corresponding to the waste of the sheet and a lower roller having a female die which cooperates with the male die on the upper roller to separate the waste from the product during passage of the sheet between the rotating upper and lower rollers.

1 Claim, 14 Drawing Figures

DIE-CUTTING APPARATUS

BACKGROUND OF THE INVENTION

The present invention relates to a die-cutting apparatus for cutting a sheet of paperboard, for example, which is being continuously fed, into a predetermined shape, and more particularly to a die-cutting apparatus which facilitates the separation of waste from a thick sheet after the thick sheet has been cut.

Generally speaking, a conventional die-cutting apparatus of the above type comprises a die cylinder which has a die secured to its outer circumference and equipped with die-cutting blades or rules arranged in a predetermined shape, and an anvil cylinder having a cover of soft material such as polyurethane plastic wound around its outer circumference. Sheets of paperboard are fed one by one from a paperboard feed table into the space between those cylinders by means of a kicker device or the like so that it can be cut into a predetermined shape by the die-cutting blades, after which it is fed out to the downstream side and stacked with the other pieces for storage. However, in such an apparatus especially when the sheet used is thick, part of the paperboard sheet being cut in the above die-cutting step is not naturally separated from the sheet, i.e., the waste frequently fails to separate from the sheet after the die-cutting step and remains thereon until it is fed out to the downstream side as it is. This makes it necessary to separate the waste from the sheet in a manual way which is a waste of human and time efficiency. As a means for eliminating such a manual operation, a method has been devised of separating the waste by a vibrator disposed in the feed path downstream of the die-cutting step for imparting vertical vibrations to the paperboard sheet. However, it is impossible to ensure the complete separation of the waste from the sheet.

SUMMARY OF THE INVENTION

In view of the above defect in the prior art, therefore, it is an object of the present invention to provide a die-cutting apparatus which makes it possible to separate the waste from a thick sheet such as a sheet of paperboard completely and automatically after the sheet has been cut into a predetermined shape.

Other objects and advantages of the present invention will become apparent from the following description made in connection with an embodiment thereof with reference to the accompanying drawings.

BRIEF DESCRIPTION OF THE DRAWINGS

One embodiment of the present invention is shown in the accompanying drawings, in which.

DESCRIPTION OF THE PREFERRED EMBODIMENT

Figure 1:
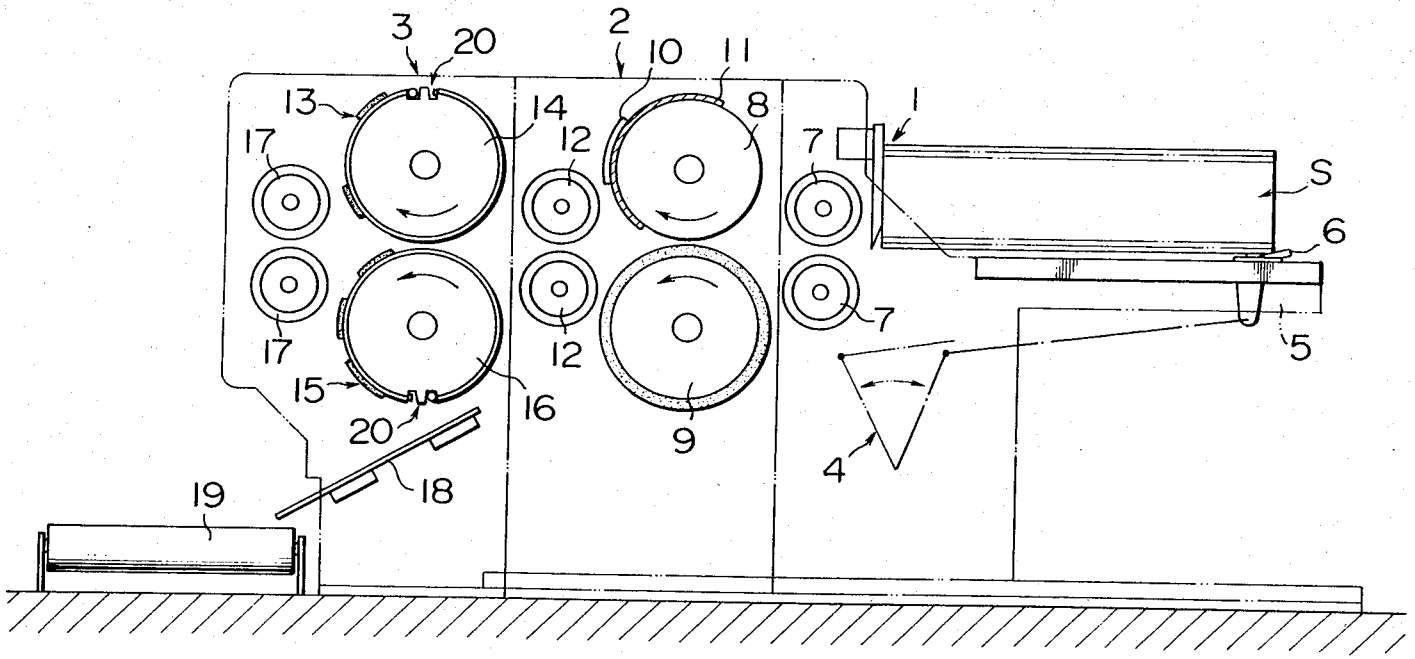
FIG. 1 is a schematic side elevation showing a die-cutting apparatus.

In FIG. 1, the die-cutting apparatus comprises a feeder 1, a die cutter 2 and a waste stripping unit 3 disposed in this order.

The paperboard feeder 1 is equipped with a kicker 6 which is moved back and forth along the upper surface of a feed table 5 a predetermined stroke by means of a rocking mechanism 4 connected to a prime driver (which is not shown). The lowermost sheet of sheets S of paperboard or the like, which are stacked on the feed table 5, is pushed consecutively one by one by the kicker 6 so that it is fed throughbetween feed rollers 7 to the die cutter 2.

Figure 2:
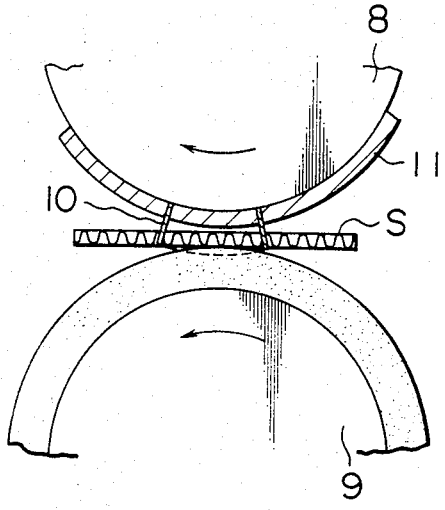
FIG. 2 is a partial side elevation showing the state in which a sheet of paperboard or the like is being cut by a die cutter.
Figure 3:
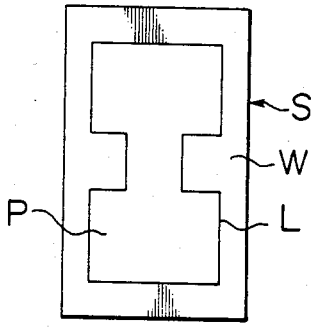
FIG. 3 is a plan view showing a sheet cut by the due cutter.

The die cutter 2 is includes a die cylinder 8 and an anvil cylinder 9. The die cylinder 3 has a die 11 secured to its outer circumference by suitable fastening means such as bolts. The die 11 is formed into a shape corresponding to the arc of said circumference and has die-cutting blades or rules 10 fixedly mounted therein in a predetermined shape for the purposes of die-cutting. The anvil cylinder 9 has its outer circumference covered with a layer of elastic resin such as polyurethane. The sheet S fed from the feeder 1 is introduced into the gap between the die and anvil cylinders 8 and 9 so that it is cut into a predetermined shape by the die-cutting blades 10, as shown in FIG. 2, and then it is fed, while being held between feed rollers 12, to the waste stripping unit 3 downstream the die cutter. The sheet S could be cut into an I shape, for example, as shown in FIG. 3. In the drawing, L indicates cuts by the die-cutting blades 10, P indicates the product, and W indicates the unneeded section, i.e., the waste, which has not been separated from the sheet S but is left as it is.

Figure 4:
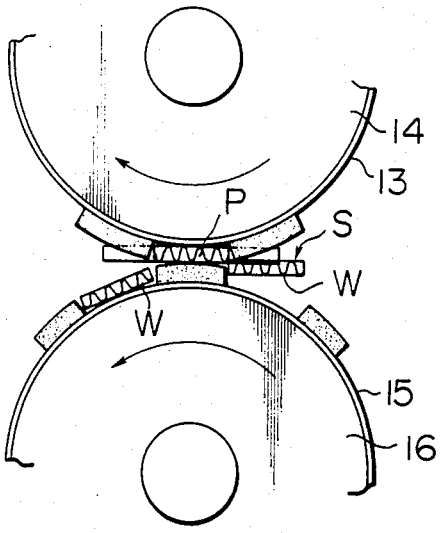
FIG. 4 is a partial side elevation showing the state in which waste is separated at a waste stripping unit from that sheet.
Figure 5:
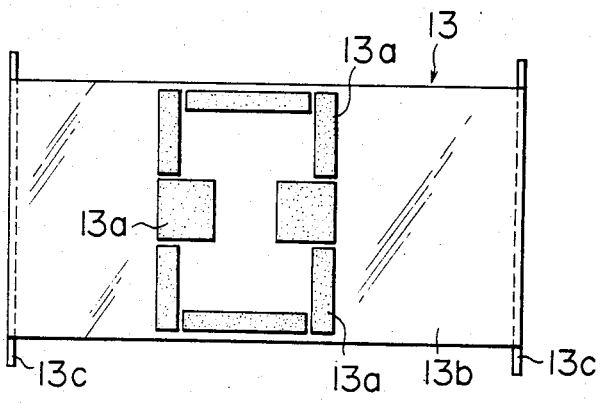
FIG. 5 is an exploded plan view showing a male die which is mounted on an upper cylinder.
Figure 6:
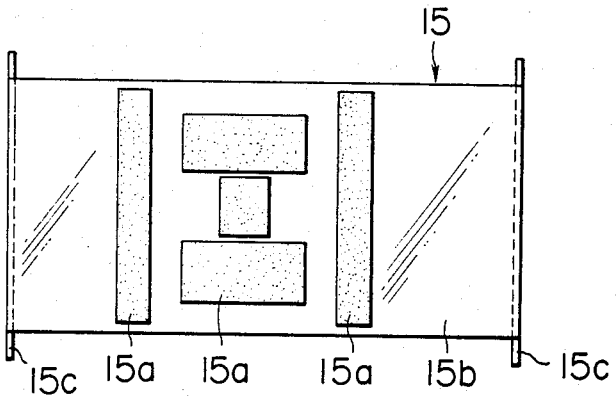
FIG. 6 is an exploded plan view showing a female die which is mounted on a lower cylinder.

The waste stripping unit 3 includes an upper roller 14, which is equipped on its outer circumference with a male die 13 for separating only the waste W from the cut sheet S, and a lower roller 16 which is equipped on its outer circumference with a female die 15 which receives only the waste W separated from the sheet by the upper roller 14 to release that waste W downward upon its rotation. Thus the sheet S is separated into the product P and the waste W, as shown in FIG. 4, by the cooperation of the upper and lower rollers 14 and 16 with each other. The product P is fed out downstream by the feed rollers 17, while the waste W is conveyed, after it has been dropped, by a scrap conveyor 19 via a vibration plate 18 to a station in which it is stacked. As shown in FIG. 5, the male die 13 of the upper roller 14 includes a flexible film 13*b* of polyester or the like to which are secured plate members 13*a* made of hard rubber or the like in a shape corresponding to the waste W of the sheet S cut by the die cutter 2. Similarly, as shown in FIG. 6, the female die 15 of the lower roller 16 includes a flexible film 15*b* of polyester or the like, to which are secured plate members 15*a* made of a similar hard rubber or the like in a shape corresponding to the contours of both the product P and the waste W of the sheet S cut by the die cutter 2. Each of these films 13*b* and 15*b* is provided at its two ends with frame bars 13*c* and 15*c*, which are connected to each of the upper and lower rollers 14 and 16 by winding units 20 disposed therein. (The winding method of those films 13*b* and 15*b* will be described below.) The plate members 13*a* and 15*a* on the films 13*b* and 15*b*, respectively, are made thicker than at least the sheet S being treated.

Figure 7:
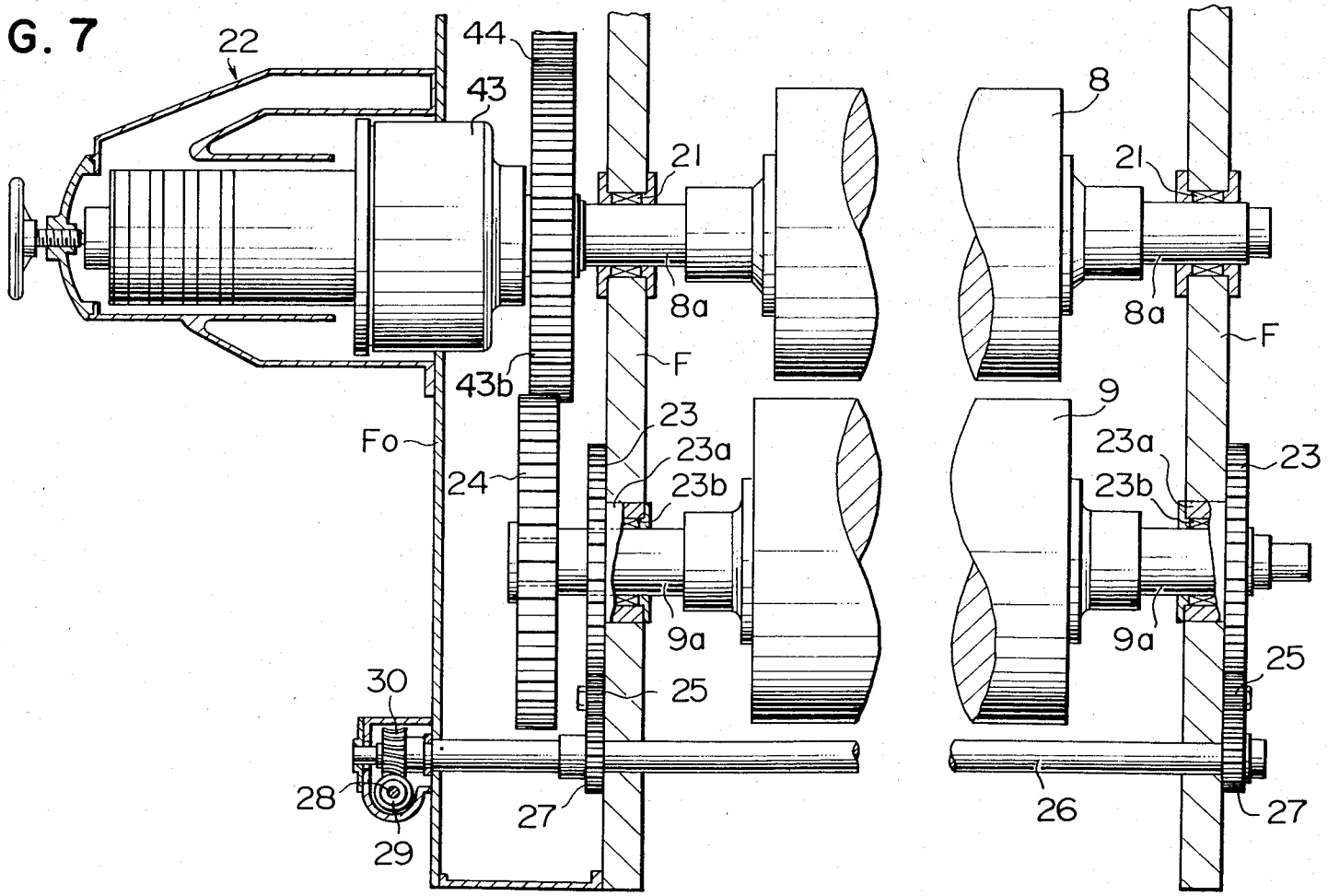
FIG. 7 is a front elevation showing details of the die cutter.

Next, the construction of the above die cutter 2 will be described in more detail with reference to FIG. 7.

In this figure, the journals 8*a* of the die cylinder 8 are supported in a frame F by bearings 21 and one of the journals is connected to a differential mechanism 22. Similarly, the journals 9*a* of the anvil cylinder 9 are supported eccentrically in bushings 23*a* through bearings 23*b*. The bushings 23*a* have gear wheels 23 integral therewith and are rotatably mounted in the frame F. One of the journals 9*a* is provided with a gear wheel 24 secured thereto. The gear wheels 23 each mesh with intermediate gear wheels 25 which are rotatably supported on the frame F. These intermediate gear wheels 25 each mesh with gear wheels 27 which are fixed on a spindle 26 rotatably supported in the frame F below the anvil cylinder 9 and parallel to the same. Reference numeral 28 indicates a handle shaft, the rotation of which is transmitted through a worm 29 and a worm gear 30 to the spindle 26. By the operation of the handle shaft 28, therefore, the anvil cylinder 9 is moved up and down relative to the die cylinder 8 in accordance with the eccentricity of the bushings 23*a* of the gears 23 so that the gap between the die cylinder 8 and the anvil cylinder 9 can be adjusted in accordance with the thickness of the sheet S being used.

Figure 9:
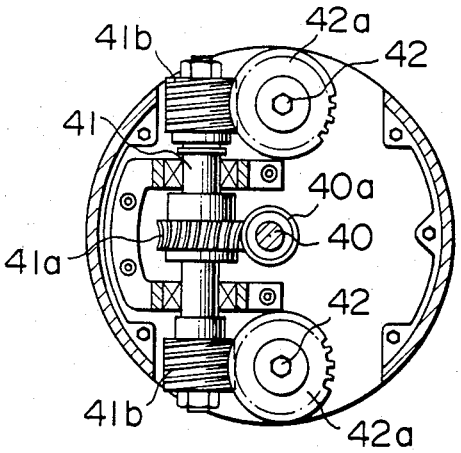
FIG. 9 is a section taken along the line A—A of FIG. 8.
Figure 8:
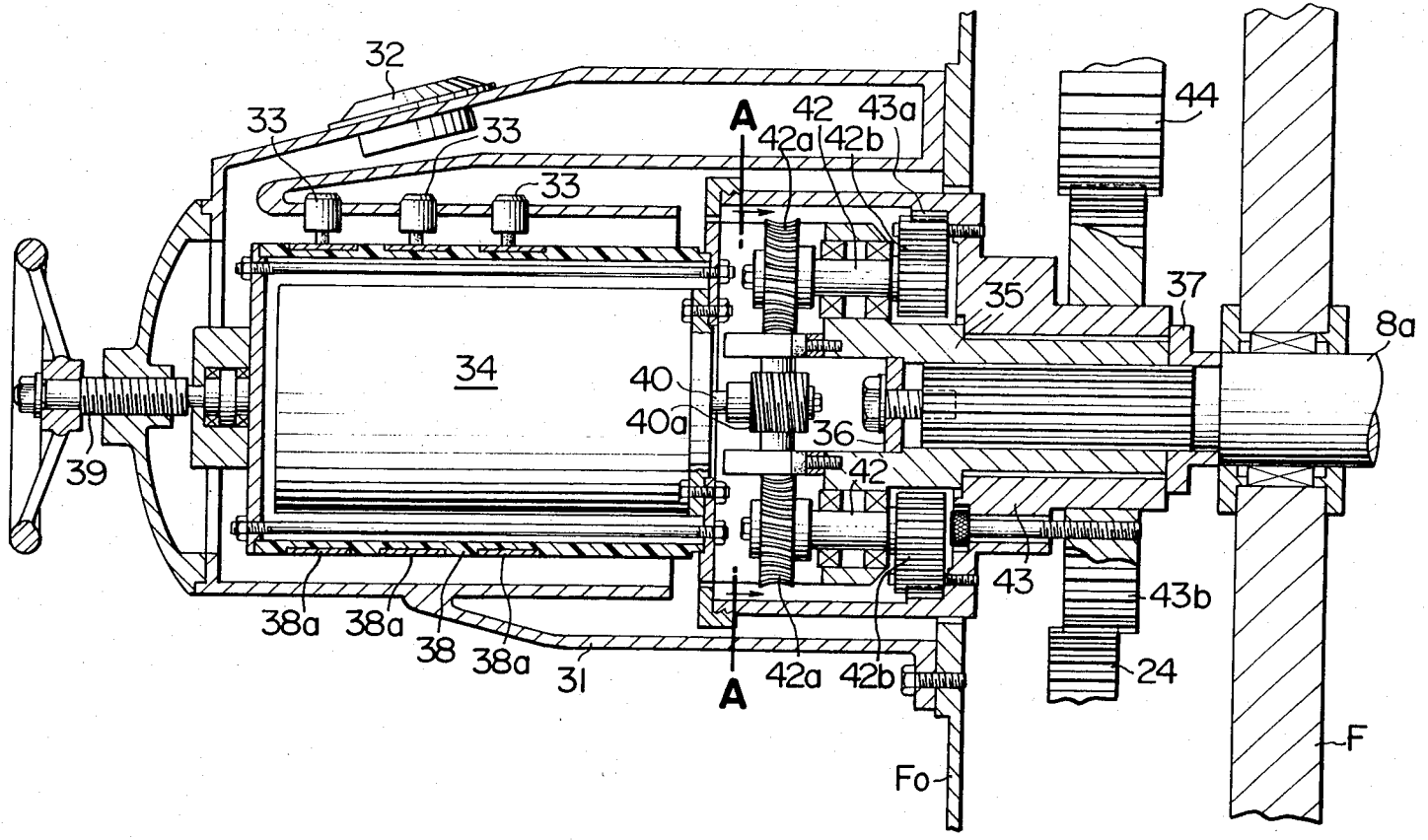
FIG. 8 is a longitudinal section showing a differential mechanism.

Next the construction of the differential mechanism 22 will be further described with reference to FIGS. 8 and 9. Reference numeral 31 in the drawing indicates a casing which is secured to an outer frame $F_O$, and a switch 32 is disposed outside the casing 31 three brushes 33 are disposed inside the casing and connected to external wires. Numeral 34 indicates a motor which is secured to the end of an inner sleeve 35 having its inner circumference splined to one of the journals 8*a*. This journal 8*a* of the die cylinder 8 is fastened by means of screws to the inner sleeve 35 between a washer 36 and a collar 37. A insulating sleeve 38 encloses the motor 34. The sleeve 38 is secured to the end of the inner sleeve 35 in a similar way to the motor 34 and has conductive copper layers 38*a* formed on its outer circumference, with which each of the brushes 33 contact, so that electric power can be supplied through that conducting layers 38*a* to the motor 34. A handle shaft 39 screwed in the casing 31 is rotatably supported at its inner end in a front end plate of the sleeve 38 such that it can move back and forth together with the sleeve 38 irrespective of its rotation. A worm 40*a* is fixed to the output shaft 40 of the motor 34 and meshes with a worm gear 41*a* fixedly secured to a shaft 41 which is supported on the inner sleeve 35 through bearing means at right angles to the axis of the inner sleeve 35. Worms 41*b* are fixed to the shaft 41 at its ends and mesh with worm gears 42*a* *which are fixed to one ends of shafts 42 parallel to the axis the inner sleeve 35 and supported therein. Gear wheels 42b* are mounted on the other ends of the shafts 42 and mesh with internal teeth 43*a* formed on the inner circumference of an outer sleeve 43 which is rotatably fitted over the inner sleeve 35 between its shoulder and the collar 37. Gear wheel 43*b* is fixedly disposed outside the outer sleeve 43 and meshes with a drive gear 44 for transmitting the power of the same prime driver as that of the rocking mechanism 4 to the gear wheel 43*b*. The gear wheel 43*b* further meshes with the gear wheel 24 fixed to one of the journal 9*a* of the anvil cylinder 9.

The operation of the differential mechanism 22 will now be described. When the motor 34 is at rest, the rotation of the drive gear 44 is transmitted partly through the gear wheel 43*b* of the outer sleeve 43 to the gear wheel 24 of the anvil cylinder 9, and partly through the internal teeth 43*a* of the outer sleeve 43 to each of the gear wheels 42*b*. Since the shafts 42 of these gears 42*b* can not rotate, however, the inner sleeve 35 is rotated together with the outer sleeve 43 to rotate the journals 8*a* of the die cylinder 8. Next, the drive gear 44 is stopped, and the switch 32 is turned on to start the motor 34. The rotation of the output shaft 40 is transmitted to each of the gear wheels 42*b* meshing with the internal teeth 43*a* of the outer sleeve 43 thereby tending to rotate the outer sleeve 43. Since this outer sleeve 43 is held against its rotation by the drive gear 44, however, the internal sleeve 35 is rotated relative to the outer sleeve 43 to rotate only the journals 8*a* of the die cylinder 8. Thus, this rotational angle of the die cylinder 8 relative to the drive gear 44 is adjusted by turning the switch 32 on and off so that the die-cutting blades 10 of the die cylinder 8 can be adjusted to a position of the sheet S to be exactly cut in accordance with the feed of the sheet S by the kicker 6 of the feeder 1. Moreover, the differential mechanism 22 in the present embodiment can move the sleeve 38 and hence the inner sleeve 35, back and forth by operating the handle shaft 39 so that the journals 8*a* of the die cylinder 8 can be moved along the longitudinal axis.

Next, the construction of the waste separator 3 will be described in more detail with reference to FIGS. 10 to 14.

Figure 10:
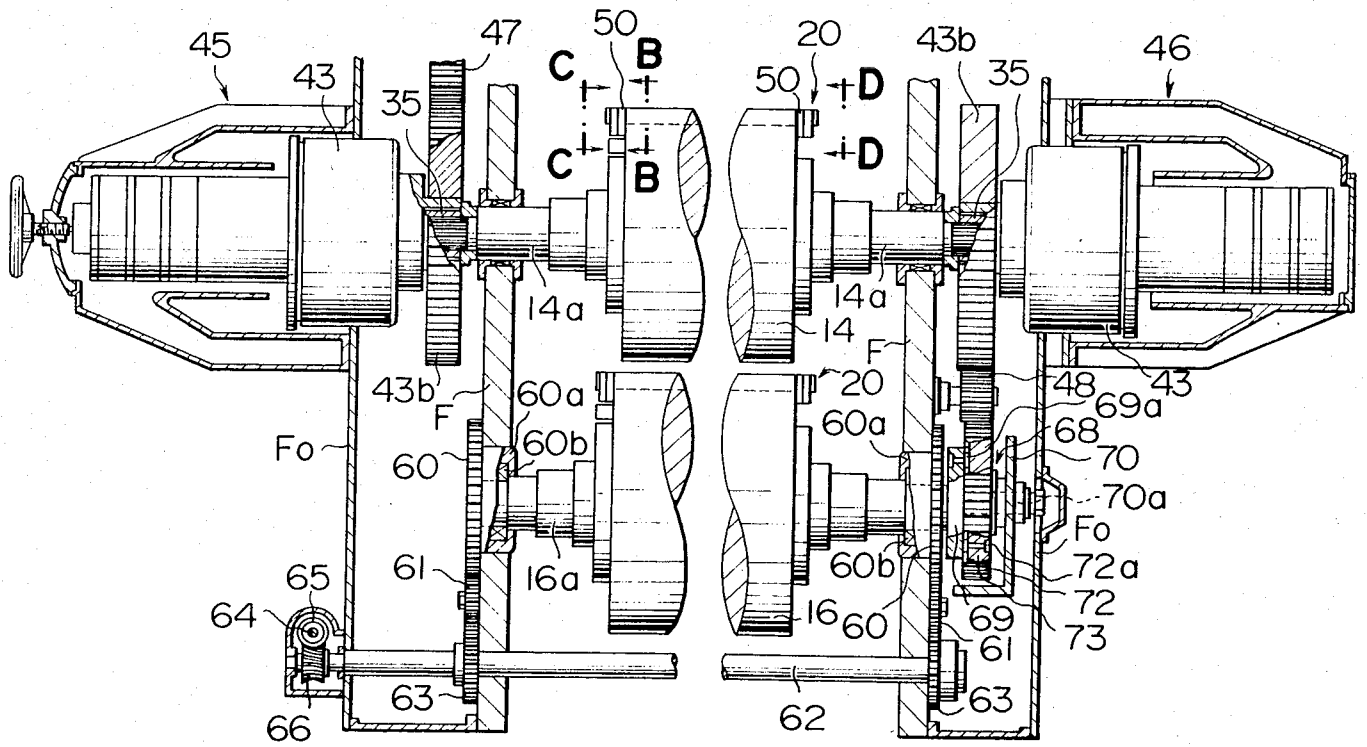
FIG. 10 is a front elevation showing details of the waste stripping unit.

In FIG. 10, journals 14*a* of the upper roller 14 are supported in the frame F and have their ends connected to differential mechanisms 45 and 46. The constructions of these differential mechanism 45 and 46 are similar to that of the differential mechanism 22 of the die cutter 2, and similar parts are indicated by identical reference numerals. However, the handle shaft 39 of the differential mechanism 22 for the die cutter 2 and its associated parts are not included in the differential mechanism 46. Here, one journal 14*a* of the upper roller 14 has its end splined to the inner sleeve 35 of the differential mechanism 45. A drive gear 47 meshes with the gear wheel 43*b* of the outer sleeve 43 of the differential mechanism 45 so as to transmit power from the same prime driver as that of the feeder 1 and die cutter 2 to the outer sleeve 43. The other journal 14*a* has its end splined to the inner sleeve 35 of the differential mechanism 46, the outer sleeve 43 of which has its gear wheel 43*b* meshing with an intermediate gear wheel 48 rotatably mounted on the frame F. In this construction, moreover, the upper roller 14 is equipped with the winding unit 20 for mounting the male die 13 thereon and the construction of which will be detailed below.

Figure 11:
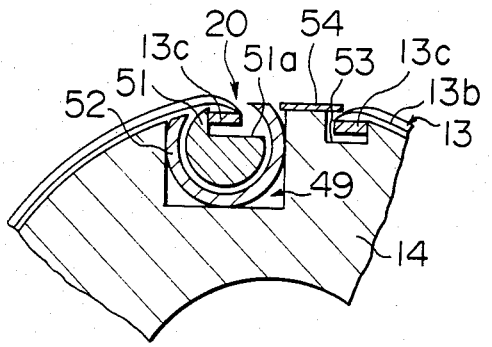
FIG. 11 is a partial section taken along the line B—B of FIG. 10.
Figure 12:
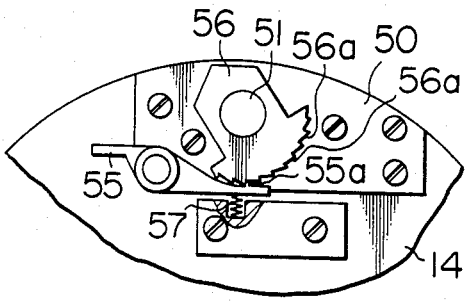
FIG. 12 is a partial section taken along the line C—C of FIG. 10.
Figure 13:
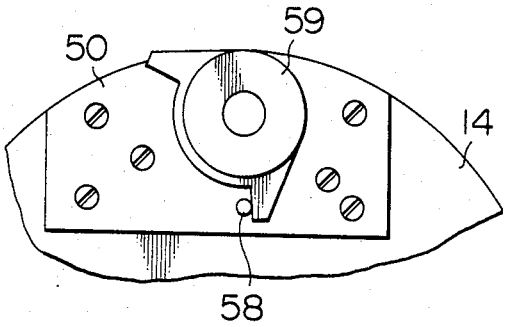
FIG. 13 is a partial section taken along the line D—D of FIG. 10.

As shown in FIG. 11, the upper roller 14 is formed with a rectangular groove 49 which extends along the whole length thereof. A mounting shaft 51 is disposed in the groove 49 and rotatably supported in support plates 50 secured to opposite ends of the upper roller 14 as shown in FIG. 12. The amounting shaft 51 is formed with a notch 51*a* which receives frame bar 13*c* on the film 13*b* of the male die 13, as shown. A notched cylinder 52 is further fixedly positioned within the groove 49, and arranged concentrically with the mount shaft 51 in spaced relationship a slight distance from the mounting shaft 51. The cylinder 5*a* has its upper open end through which the frame 13*c* can be inserted to the notch 51*a* in the shaft 51. A recess 53 is formed in the upper roller 14 in the vicinity of the groove 49 to receive the frame bar 13*c* attached to the other end of the film 13*b*. This frame bar 13*c* is further prevented from coming out of the recess by means of a retaining member 54 which is positioned on the roller 14 so as to protrude into the recess 53. A ratchet wheel 56 is secured to one end of the mounting shaft 51, as shown in FIG. 12, and is equipped with teeth 56*a* that can engage with the pawl 55*a* on a ratchet 55 rotatably mounted on the end face of the upper roller 14. A spring 57 forces upwardly the ratchet 55 to its pawl 55*a* into engagement with one of the teeth 56*a* of the ratchet wheel 56. This ratchet wheel 56 can rotated clockwise against the action of the spring 57 but is prevented from rotating in the counter-clockwise direction. A stopper 59 is secured to the other end of the mounting shaft 51, as shown in FIG. 13 to restrict the rotation of the ratchet wheel 56 to a predetermined range by impinging against a pin 58 secured to the end face of the upper roller 14. With the construction thus far described, after the frame bars 13*c* and 13*c* of the film 13*b* have been set in the notch 51*a* and recess 53, the mounting shaft 51 is rotated in the clockwise direction in FIG. 11 so that the end portion of the film 13*b* is wound around the mounting shaft 51 between it and the notched cylinder 52 to come into close contact with the outer circumference of the upper roller 14. The rotation of the mounting shaft 51 is stopped when the film 13*b* reaches the state at which it is in close contact with the upper roller 14, and the mounting shaft 51 is fixedly held at that position without returning by the cooperating ratchet wheel 56 and the ratchet 55. The female die 15 is mounted on the lower roller 16 in a similar way by another winding unit 20.

Figure 14:
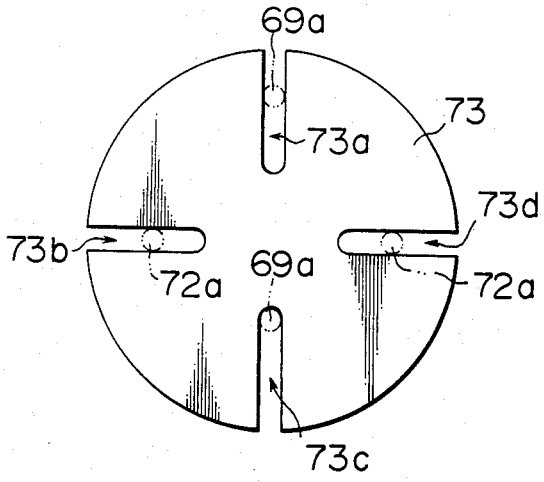
FIG. 14 is a plan view showing the disc of an Oldham's coupling.

The journals 16*a* of the lower roller 16 are eccentrically supported in bushings 60*a* through bearings 60*b*. The bushings 60*a* is rotatably mounted in the frame F and have gear wheels 60 integral therewith. Each of the gear wheels 60 meshes with intermediate gear wheels 61 which are rotatably mounted on the frame F and mesh with gear wheels 63 fixedly secured to a spindle 62 which is rotatably supported in the frame F. Reference numeral 64 indicates a handle shaft, the rotation of which is transmitted through a worm 65 and a worm gear 66 to the spindle 62. The mechanism thus described is similar to that of the anvil cylinder 9 of the die cutter 2 so that the lower roller 16 can be moved vertically relative to the upper roller 14 in accordance with the eccentricity of the bushings of the gear wheels 60 by the operation of the handle shaft 64 to adjus a gap between the upper and lower rollers 14 and 16. An Oldham's coupling 68 is disposed at one end of that lower roller 16 to transmit the power from the gear wheel 43*b* of the differential mechanism 46 through the intermediate gear wheel 48 rotatably mounted on the frame F, to the journals 16*a* of the lower roller 16 irrespective of the vertical movements of the roller 16. The Oldham's coupling 68 includes a connecting plate 49 secured to the end of one of the journals 16*a*, a gear wheel 72 on a journal 70*a* which is mounted on a bracket 70 attached to the frame F, and a disc 73 which is interposed between the connecting plate 69 and gear wheel 72. As shown in FIG. 14, the disc 73 is formed with four angularly spaced slots 73*a*, 73*b*, 73*c* and 73*d* extending from the circumferential edge toward the center. One pair of diametrically opposite slots 73*a* and 73*c* receive the ball-shaped heads of a pair of corresponding pins 69*a* fixed to the connecting plate 69, whereas the other pair of diametrically opposite slots 73*b* and 73*d* receive the ball-shaped heads of a pair of corresponding pins 72*a* fixed to the gear wheel 72. By the action of the Oldham's coupling 68 thus constructed, the rotation of the gear wheel 72 is transmitted positively through the connecting plate 69 to the journals 16*a* irrespective of the vertical movement of said journals 16*a* which is based upon the operation of the handle shaft 64.

The operational effects of the waste separator 3 will be described below.

When the differential mechanisms 45 and 46 are in their inactive position, the rotation of the drive gear 47 is transmitted in the same way as in the die cutter 2 through the gear wheel 43*b* of the differential mechanism 45 to the journals 14*a* of the upper roller 14. The rotation of these journals 14*a* is further transmitted from the inner sleeve 35 to the outer sleeve 43 of the differential mechanism 46. The rotation of the outer sleeve 43 is further transmitted from its gear wheel 43*a* through the intermediate gear wheel 48 and the Oldham's coupling 68 to the journals 16*a* of the lower roller 16 to rotate it in synchronized relation with the upper roller 14.

In the foregoing description, the upper and lower rollers 14 and 16 are so preset as to be at a predetermined rotational phase angle with respect to the die cylinder 8, so that the male and female dies 13 and 15 on the upper and lower rollers 14 and 16 cooperate with the waste W and the product P of the sheet S fed out of the die cutter 2, respectively. However, when the die cylinder 8 is adjusted rotationally by the differential mechanism 22, as described above, or is brought out of phase by another mechanical condition, the state in which the separation of the waste W from the product P is not properly conducted, or at worst the phenomenon in which the product P is broken, could arise. Because of this fact, the waste stripping unit 3 of the present embodiment is capable of adjusting the phase of the upper and lower rollers 14 and 16 with respect to the die cylinder 8 by the action of the differential mechanism 45. If the motor 34 of the differential mechanism 45 is started, the journals 14*a* of the upper roller 14 are rotated together with the inner sleeve 35 relative to the outer sleeve 43 to transmit their rotations to the journals 16*a* of the lower roller 16, as described above so that the upper and lower rollers 14 and 16 are simultaneously shifted through the same phase with respect to the drive gear 47. As a result, the upper and lower rollers 14 and 16 can be set at the proper phase by adjusting the amount of rotation of the motor 34. Moreover, it will be noted the male and female dies 13 and 15 can be replaced by others in accordance with different die-cutting blades 10 being applied to the die cylinder 8. This makes it further necessary to adjust the mutual rotational phases of the upper and lower rollers 14 and 16.

This adjustment can be effected by the differential mechanism 46. If the motor 34 of the differential mechanism 46 is started, the outer sleeve 43 is rotated relative to the inner sleeve 35 because the journals 14*a* of the upper roller 14 are held against their rotations by the drive gear 47, and then, the rotation of the outer sleeve 43 is transmitted from the intermediate gear wheel 48 through the gear wheel 72 of the Oldham's coupling 68 to the journals 16*a* of the lower roller 16. As a result, the lower roller 16 is rotated relative to the upper roller 14 so that it can be set at the proper phase by adjusting the amount of rotation of the motor 34. Incidentally, it is obvious that both the phase adjustment of the upper and lower rollers 14 and 16 relative to the die cylinder 8, and the phase adjustment of the lower roller 16 relative to the upper roller 14, although both have been described, can be conducted whether the drive gear 47 is rotating or is stopped. In the waste separator 3 thus described, moreover, the upper roller 14 can be moved axially thereof relative to the lower roller 16 in the same way as in the die cylinder 8 of the die cutter 2 by operating the handle shaft 39 of the differential mechanism 45 so that the widthwise position of the male die 13 of the upper roller 14 with respect to the female die 15 of the lower roller 16 can be adjusted. As a result, after the upper roller 14 is moved axially to adjust its position with respect to the lower roller 16, as described above, the mutual positions can be set in the most ideal state by adjusting the positions of the die cylinder 8 and the feeder 1 across the width of the sheet S with respect to those lower and upper rollers 16 and 14 in addition to the above rotational phase adjustment.

Incidentally, the waste separator 3 of the present embodiment is so constructed, as described above, that the differential mechanisms 45 and 46 are connected to the ends of both journals 14*a* of the upper roller 14 so that the rotational phase adjustment relative to the drive side, i.e., the drive gear 47, may be effected by the differential mechanism 45 whereas the rotational phase adjustment of the lower roller 16 relative to the upper roller 14 may be effected by the differential mechanism 46. It is, however, perfectly possible to construct these differential mechanisms in such a way that they are separately attached to the upper and lower rollers 14 and 16 so that they may ensure the phase adjustments independently of each other with respect to their respective drive sides.

As has been described hereinbefore, the present invention has an advantage in that the separation of waste from the sheet can be continuously and automatically ensured without any manual operation by the provision of waste stripping unit which includes: an upper roller equipped on its outer circumference with a male die cooperating with the waste of the sheet material, and a lower roller equipped on its outer circumference with a female die cooperating with the male die on the upper roller, so that only the waste may be separated from the sheet material, while leaving the product, by squeezing the sheet material between the upper and lower rollers.

By providing the waste stripping unit with differential mechanisms which can adjust both the rotational phases of the upper and lower rollers with respect to the drive side of said waste separator, and the rotational phase relative to each other, moreover, any discrepancy between the operating positions of the male and female dies, which is invited by any displacement of the die-cutting blades of the die cutter, the male die of the upper roller and the female die of the lower roller, and other mechanical causes, can be corrected by the differential mechanisms to thereby improve the working accuracy and to reduce erroneous products, i.e., to improve the yield.

What is claimed is:

1. A die-cutting apparatus comprising:

(a) a feeder for continuously feeding out sheet materials or the like;

(b) a die cutter including a die cylinder having die-cutting blades arranged on its outer circumference in a predetermined shape and an anvil cylinder positioned to cooperate with said die cylinder, the sheet material from said feeder being cut into a product and waste by the die cutting blades on said die cylinder during passage of the sheet between the die and anvil cylinders; and (c) a waste stripping unit including an upper roller having on its outer circumference a male die which corresponds to the waste of said sheet material, and a lower roller having on its outer circumference a female die which cooperates with the male die of said upper roller to exclusively separate said waste, while leaving said product, from said sheet material by squeezing the sheet material from said die cutter between said upper roller and said lower roller, said waste stripping unit further including differential means for adjusting the rotational phases of said upper roller and said lower roller with respect to the drive side of said waste separator, and the mutual rotational phase of said rollers.

* * * * *